US006627856B2

(12) United States Patent
Korwin et al.

(10) Patent No.: US 6,627,856 B2
(45) Date of Patent: Sep. 30, 2003

(54) MOVEABLE HEAT EXCHANGER

(75) Inventors: Michel J. Korwin, Westmount (CA); Janusz Szymborski, Pointe Claire (CA)

(73) Assignee: Nitrex Metal Inc., St. Laurent (CA)

( * ) Notice: Subject to any disclaimer, the term of this patent is extended or adjusted under 35 U.S.C. 154(b) by 0 days.

(21) Appl. No.: 10/025,755

(22) Filed: Dec. 26, 2001

(65) Prior Publication Data

US 2003/0116554 A1 Jun. 26, 2003

(51) Int. Cl.[7] ..... C23C 8/24; F27B 3/26; F27D 9/00

(52) U.S. Cl. ..... 219/400; 219/399; 165/61; 165/86; 165/912; 148/238; 427/374.1; 432/82

(58) Field of Search ..... 219/399, 400; 165/61, 86, 58, 59, 912; 148/238; 118/724; 427/374.1; 432/82

(56) References Cited

U.S. PATENT DOCUMENTS 4,480,628 A * 11/1984 Simpson ..... 219/400
5,273,585 A * 12/1993 Shoga et al. ..... 165/58
5,624,255 A 4/1997 Hisada et al.
5,845,631 A * 12/1998 Kleva et al. ..... 219/400
5,865,908 A 2/1999 Takei et al.
5,871,806 A 2/1999 Shoga et al.
6,024,893 A 2/2000 Keil et al.
6,065,964 A 5/2000 Pelissier

OTHER PUBLICATIONS

Czelusniak et al., "NITREG: NITREG–ONC; NITREG–S; advanced surface hardening technologies for steel through nitrogen implantation", Nitrex Metal Inc., St–Laurent, Quebec, Canada.

"NITREG—Controlled Gas Nitriding Process", Nitrex Metal Inc., St–Laurent, Quebec, Canada.

* cited by examiner

*Primary Examiner*—Joseph Pelham
(74) *Attorney, Agent, or Firm*—Freedman & Associates

(57) ABSTRACT

Disclosed is a moveable heat exchanger for use with a high temperature chamber, such as for instance a nitriding furnace. The heat exchanger is between a first position external to the furnace, and a second position in which the heat exchanger projects substantially into the furnace through an opening in a wall surface of the furnace. In use, the heat exchanger is in the first position during a high temperature portion of a process and is in the second position during a cooling portion subsequent to the high temperature portion of the process. The heat exchanger sealingly engages the wall surface about its periphery to prevent the exchange of atmospheric components in either direction between the interior of the furnace and the outside.

22 Claims, 6 Drawing Sheets

MOVEABLE HEAT EXCHANGER

FIELD OF THE INVENTION

This invention relates generally to heat exchangers for rapidly cooling the contents of a high-temperature chamber. In particular, this invention relates to a heat exchanger movable between a first position external to the chamber during a high-temperature step of a process and a second position internal to the chamber during a cooling step of the process.

BACKGROUND OF THE INVENTION

Nitriding is a process of enriching with nitrogen the surface layer of steel, resulting in the formation of a hardened surface on machine components with improved fatigue, wear and/or seizing resistance. In conventional gas nitriding, carried out in partially dissociated ammonia gas at 500–600° C., the superficial nitrogen concentration cannot be controlled. The combined nitrogen and carbon concentration at the surface reaches 11.3%, bringing about the formation of a single phase zone consisting mainly of carbonitrides. Such high nitrogen concentrations in the superficial layer are undesirable as they are the cause of porosity, brittleness and spalling. In addition, conventional gas nitriding cannot easily be repeated to achieve consistent results.

Liliental, Morawski and Tymowski teach in a paper entitled, "Controlled Gas Nitriding —The Modern Surface Treatment for the Automotive Industry" published in the proceedings of the ASM conference on automotive heat treatment, Puerto Vallarta, Mexico, July 1998, a controlled atmosphere gas nitriding process, which process retains the major advantages of gas nitriding, including negligible dimensional changes and relatively low treatment temperature. Specifically, the nitriding potential of the furnace atmosphere, expressed as the ratio of ammonia and hydrogen partial pressures, is controlled. Further, a controlled rate of cooling after treatment can inhibit the formation of undesirable nitrides or carbonitrides in the compound and diffusion zones of the nitrided layer, thus improving the properties of the case.

Unfortunately, the maximum cooling rate that is attainable using a prior art furnace often is insufficient to rapidly cool the components while simultaneously maintaining a constant nitriding potential of the furnace atmosphere. As a result, the case hardened components may not develop the expected properties and may even be at risk of failing prematurely. More specifically, the toxic atmosphere of partially dissociated ammonia cannot easily be vented to outside of the furnace without first being neutralized using special equipment. Venting of the atmosphere creates an additional problem in that the cooling gas supplied to replace the vented atmosphere must have an identical composition, thus increasing the operating costs associated with acquisition and disposal of toxic chemical substances.

In U.S. Pat. No. 5,871,806, issued Feb. 16, 1999 in the name of Shoga et al., disclosed is a method and apparatus utilizing a cooling gas in order to cool an object in a cooling zone of a heat-treating apparatus. Shoga et al. teach a heat-treating apparatus comprising a heat-treating zone for heat-treating an object in a controlled atmosphere and a cooling zone for cooling the heat-treated object using a cooling gas, wherein the heat-treating zone and the cooling zone communicate through a door. Unfortunately, such an apparatus is poorly suited for batch-processing operations, for example using a pit furnace to case harden large loads of metal components.

It is a disadvantage of the prior art systems that nitrided components are transferred to a second other chamber subsequent to high-temperature treatment for cooling under a separate atmosphere. Often, undesirable nitride precipitates develop at component surfaces that are cooled under an improperly controlled atmosphere.

It would be advantageous to provide a cooling apparatus for use with a nitriding furnace, the cooling apparatus capable of cooling rapidly the contents of the furnace while other than affecting the chemical composition of an atmosphere contained by the furnace. A furnace equipped with such a cooling apparatus would be capable of producing high-quality nitrided components while avoiding undesirable porosity, brittleness and spalling.

OBJECT OF THE INVENTION

In an attempt to overcome these and other limitations of the prior art it is an object of the instant invention to provide an apparatus for cooling rapidly the contents of a furnace.

In an attempt to overcome these and other limitations of the prior art it is another object of the instant invention to provide an apparatus for cooling rapidly the contents of a furnace while other than affecting the chemical composition of an atmosphere contained therein.

In an attempt to overcome these and other limitations of the prior art it is yet another object of the instant invention to provide an apparatus for cooling rapidly the contents of a furnace operating in a batch mode.

SUMMARY OF THE INVENTION

In accordance with the present invention there is provided a method for cooling a workpiece within a high-temperature chamber comprising the steps of: heating the workpiece; and, moving a moveable heat exchanger into the high-temperature chamber, such that a cooling rate of the workpiece is achieved that is relatively faster than a cooling rate obtained absent the moveable heat exchanger.

According to a further aspect of the invention there is provided an apparatus for cooling a workpiece within a high-temperature chamber comprising: a heat exchanger moveable between a first position in which the heat exchanger is thermally isolated from a gas atmosphere contained within the high-temperature chamber and a second position in which the heat exchanger is in thermal communication with the gas atmosphere; an actuator operatively coupled to the heat exchanger for moving selectively the heat exchanger between the first position and second position through a port of the high-temperature chamber; and, a seal disposed between opposing surfaces of the heat exchanger and the port for substantially containing the gas atmosphere within the high temperature chamber.

According to another aspect of the invention there is provided a heat treatment system comprising: a moveable heat exchanger; a high-temperature chamber having a port through a wall surface thereof for sealingly engaging an opposing surface of the heat exchanger and for permitting at least a portion of the heat exchanger to be removeably inserted within the high-temperature chamber, and having at least an orifice in communication with an atmosphere control system for providing a gas atmosphere with a predetermined composition; an actuator operatively coupled to the heat exchanger for relatively moving the heat exchanger to the high-temperature chamber to selectively insert the at least a portion of the heat exchanger through the port; a process controller in electrical communication with the actuator for providing to the actuator a first control signal for controlling the movement of the heat exchanger, wherein, in use, the heat exchanger is in thermal communication with the gas atmosphere when inserted in the high-temperature chamber and thermally isolated from the gas atmosphere when removed from the high-temperature chamber.

BRIEF DESCRIPTION OF THE DRAWINGS

Exemplary embodiments of the invention will now be described in conjunction with the following drawings, in which similar reference numbers designate similar items.

DETAILED DESCRIPTION OF THE INVENTION

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and the scope of the invention. Thus, the present invention is not intended to be limited to the embodiments disclosed, but is to be accorded the widest scope consistent with the principles and features disclosed herein.

Figure 1A:
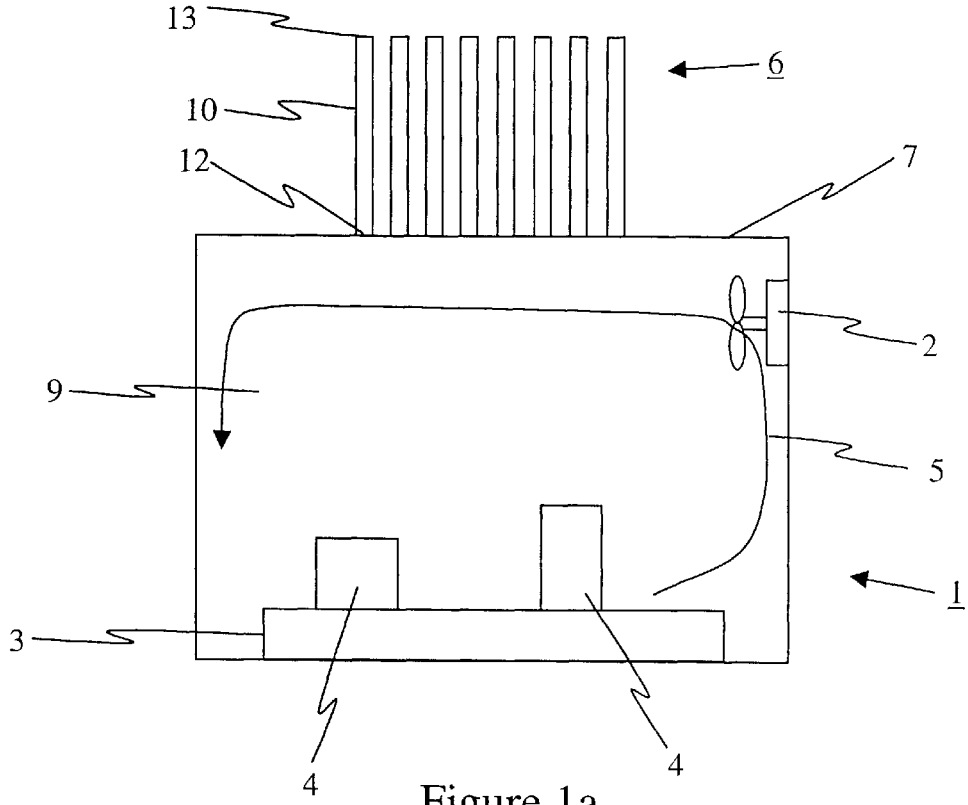
FIG. 1*a* shows a simplified block diagram of a moveable heat exchanger in a first position, according to a first embodiment of the instant invention.
Figure 3A:
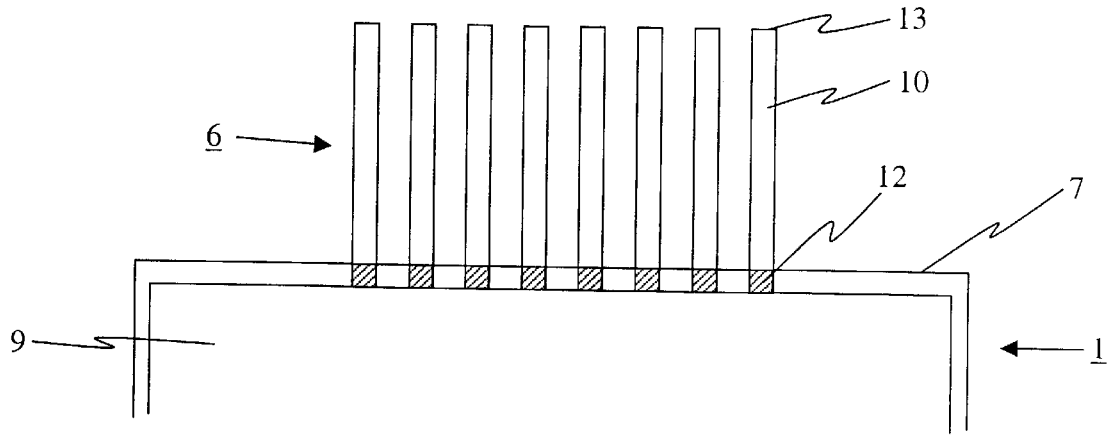
FIG. 3*a* is a simplified block diagram of a moveable heat exchanger according to a first embodiment of the instant invention, during a heating portion of a heat-treatment process.

Referring to FIGS. 1*a* and 3*a,* simplified block diagrams of a moveable heat exchanger 6 in a first position are shown according to a first embodiment of the instant invention. The moveable heat exchanger 6 comprises at least a cooling rod 10 disposed adjacent to a wall surface 7 of a high temperature chamber, such as for instance a nitriding furnace 1. Most preferably, the moveable heat exchanger 6 comprises a plurality of rods. Each rod 10 is disposed relative to the surface 7 such that the rod 10 engages at an insulated first end 12 thereof a matching port (not shown) of the surface 7. The insulated first end 12, which is shown most clearly in FIG. 3*a,* reduces heat transfer from the cavity 9 to the rod 10 during the high-temperature portion of the nitriding process. An actuator (not shown) is provided for relatively moving the rods 10 with respect to the furnace 1 to removeably insert the rods 10 at least partially into the cavity 9. The actuator is selected from a group including: a hydraulic actuator, a pneumatic actuator and a mechanical (chain/gear etc.) actuator. Each of the rods 10 at a second end 13 thereof is in thermal communication with a heat sink (not shown).

Referring again to FIG. 1*a,* the workpieces 4 that are to be nitrided are, in use, arranged on a rack 3 and loaded into the cavity 9 for batch processing. The cavity 9 is hermetically sealed to allow a controlled atmosphere to be maintained around the workpieces 4 during the nitriding process. As such, each matching port sealingly engages the rod 10 projecting therethrough in order to prevent leakage of the nitriding atmosphere from the cavity 9. Optionally, the gas pressure inside the cavity 9 is maintained above the external atmospheric pressure in order to prevent contaminants from entering the cavity 9. Heaters (not shown) supply heat to raise the temperature of the atmosphere within the cavity 9, and a fan 2 circulates continuously the atmosphere, as indicated by line 5, to ensure consistent heating of the workpieces 4. Preferably, the fan is an efficient atmosphere recirculation fan that permits a high degree of temperature uniformity to be reached in steady state conditions, with maximum deviations from ±2° C. (±3.6° F.) to ±5° C. (±9° F.), depending on the furnace size and arrangement. Optionally, a feedback control system (not shown) is provided for maintaining predetermined temperature and nitriding potential conditions, absent human intervention, during the nitriding process.

Figure 1B:
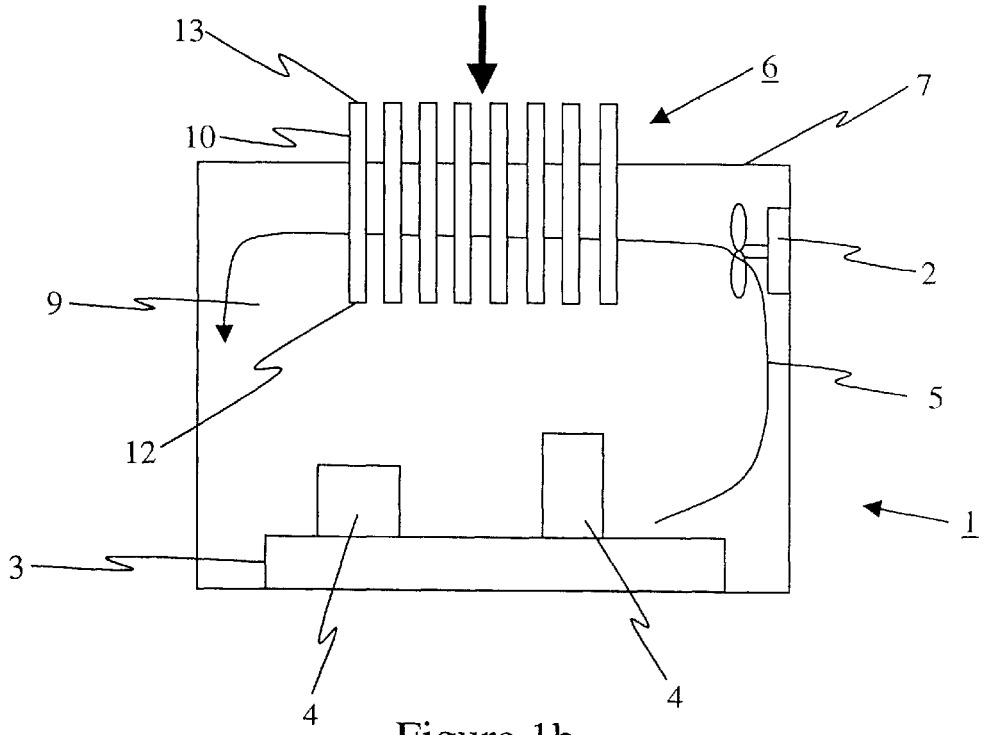
FIG. 1*b* shows a simplified block diagram of a moveable heat exchanger in a second position, according to a first embodiment of the instant invention.
Figure 3B:
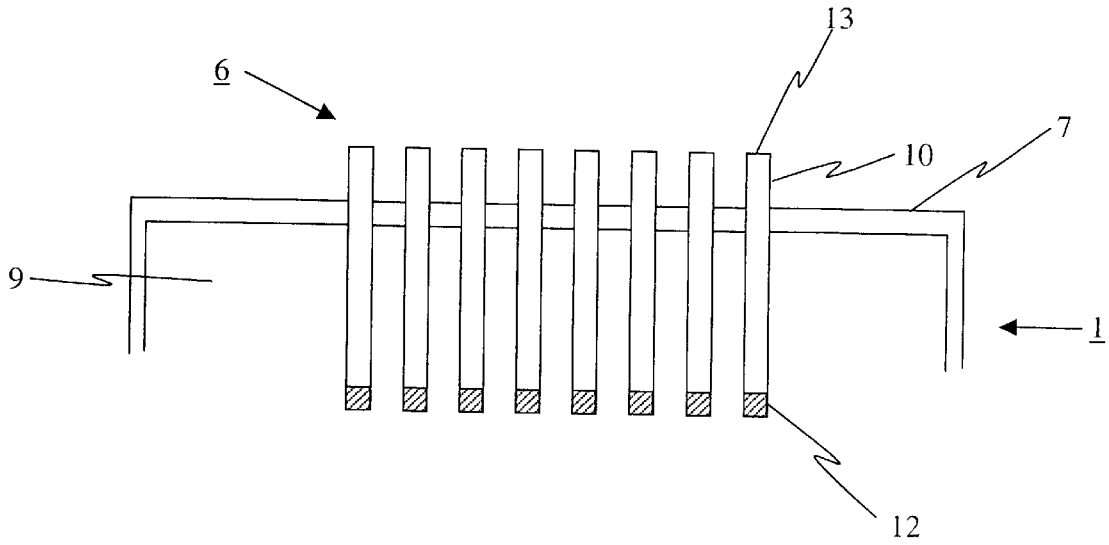
FIG. 3*b* is a simplified block diagram of a moveable heat exchanger according to a first embodiment of the instant invention, during a cooling portion of a heat-treatment process.

Referring now to FIGS. 1*b* and 3*b,* shown are simplified block diagrams of a moveable heat exchanger according to a first embodiment of the instant invention in a second position. Those drawing elements identical to drawing elements described previously with reference to FIGS. 1*a* and 3*a* have been assigned identical reference numerals, and their description is omitted here for the sake of brevity. When in the second position, the rods 10 of heat exchanger 6 project substantially through the port (not shown) in surface 7 so as to come into contact with the gas flow path 5. In use, heat is transferred from the gas flow 5 to the cooling rods 10 when they are in the second position and conducted out of the cavity 9 to the heat sink. The fan 2 provides sufficient atmospheric circulation to ensure consistent cooling of workpieces 4 that are arranged on rack 3.

Figure 1C:
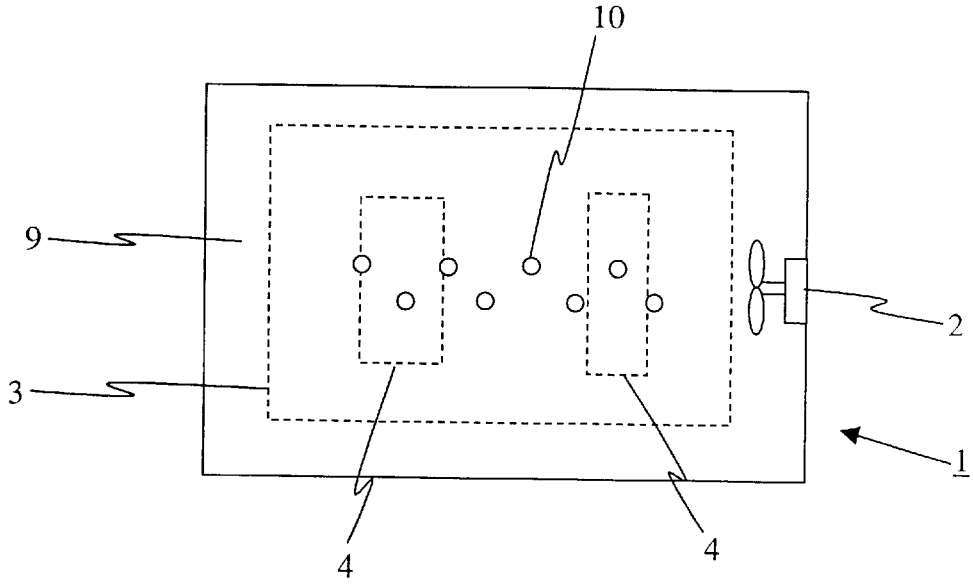
FIG. 1*c* is a top-view simplified block diagram of a moveable heat exchanger according to a first embodiment of the instant invention.

Referring to FIG. 1*c,* shown is a top-view simplified block diagram of a moveable heat exchanger according to a first embodiment of the instant invention. Those drawing elements identical to drawing elements described previously with reference to FIGS. 1*a* and 3*a* have been assigned identical reference numerals, and their description is omitted here for the sake of brevity. In particular, FIG. 1*c* depicts an end-on view of a first arrangement of a plurality of cooling rods 10. The rods 10 are arranged such that, in use, the fan 2 directs a flow of the atmosphere generally toward the rods 10. Heat is transferred from the gas flow 5 to the cooling rods 10 when they are in the second position and conducted out of the cavity 9 to the heat sink. Of course any number of rods 10 is provided in dependence upon the cooling requirements of the furnace 1. Further, rods having other than a substantially circular cross-section and/or rods of different size, in any suitable combination and spatial relationship, are envisaged for use with the instant invention.

Figure 1D:
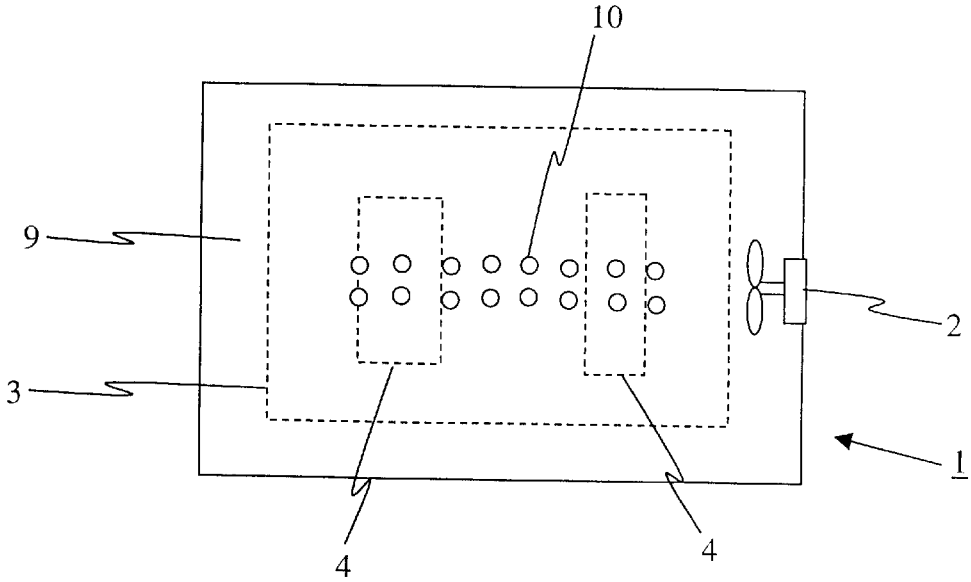
FIG. 1*d* is a top-view simplified block diagram of another moveable heat exchanger according to a first embodiment of the instant invention.

Referring to FIG. 1*d,* shown is a top-view simplified block diagram of another moveable heat exchanger according to a first embodiment of the instant invention. Those drawing elements identical to drawing elements described previously with reference to FIGS. 1*a* and 3*a* have been assigned identical reference numerals, and their description is omitted here for the sake of brevity. In particular, FIG. 1*d* depicts an end-on view of a first arrangement of a plurality of cooling rods 10. The rods 10 are arranged such that, in use, the fan 2 directs a flow of the atmosphere generally toward the rods 10. Heat is transferred from the gas flow 5 to the cooling rods 10 when they are in the second position and conducted out of the cavity 9 to the heat sink. Of course any number of rods 10 is provided in dependence upon the cooling requirements of the furnace 1. Further, rods having other than a substantially circular cross-section and/or rods of different size, in any suitable combination and spatial relationship, are envisaged for use with the instant invention.

Advantageously, the use moveable heat exchanger 6 allows rapid and consistent cooling of the contents of cavity 9, without affecting the composition of the atmosphere contained therein. Maintaining a controlled nitriding atmosphere during the cooling step improves the case properties of the nitrided product by virtue of arresting excessive nitride precipitations and produces results that are more consistent from one batch of workpieces 4 to another. Further advantageously, rapid cooling shortens cycle time, resulting in a better utilization rate of the equipment by the user and reducing the overall cost of the gas nitriding process.

Of course, each rod 10 of the plurality of cooling rods described with reference to FIGS. 1*a*–1*d* and FIGS. 3*a* and 3*b* has been depicted with its longitudinal axis substantially normal to a same surface 7. As will be obvious to one of skill in the art, numerous modifications such as inserting the rods 10 into cavity 9 via ports in at least two surfaces, and/or providing at least some rods 10 that are other than normal to the surface 7, are possible. Optionally, the rods 10 are independently moveable such that the actuator is capable of inserting a subset of the plurality of rods. Advantageously, inserting a subset of cooling rods 10 permits the selection of a predetermined cooling rate from a range of cooling rates. Further optionally, the rods 10 are in the form of heat tubes having a large surface area (not shown) at the second end 13 relative to the first end 12 for transferring heat that is absorbed at the first end 12 to the heat sink in thermal communication with the second end 13. Still further optionally the rods 10 are cooled using one of a refrigerant fluid and a thermo-electric effect.

Figure 2A:
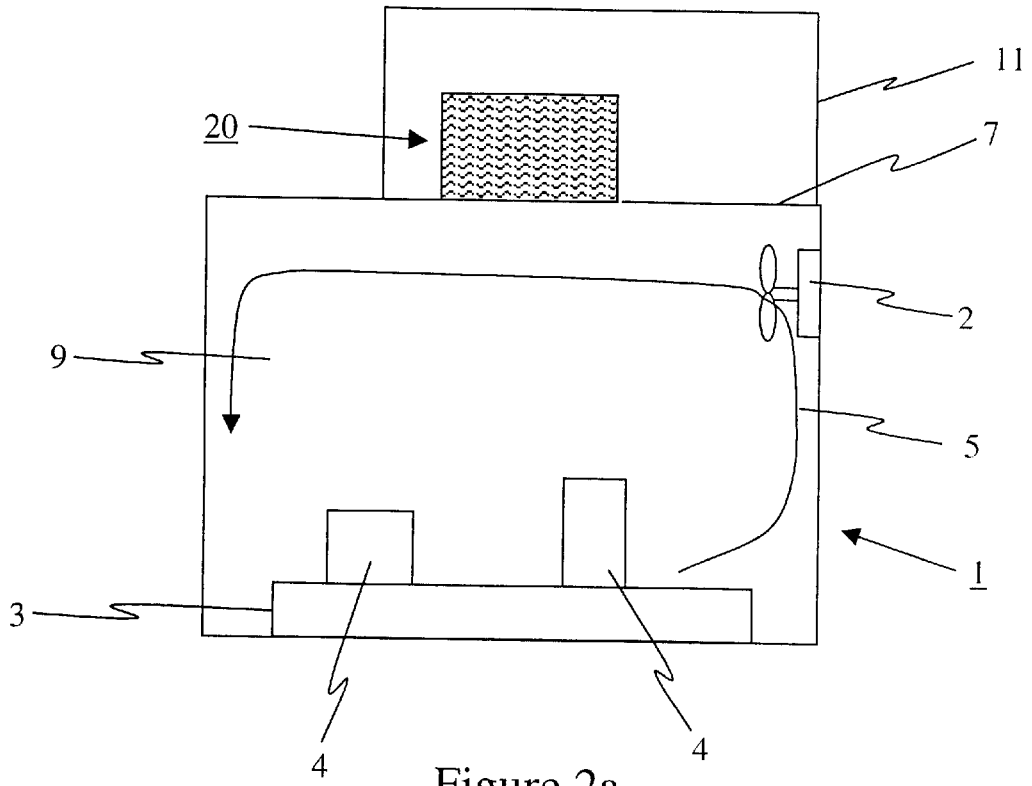
FIG. 2*a* shows a simplified block diagram of a moveable unified heat exchanger in a first position, according to a second embodiment of the instant invention.
Figure 4A:
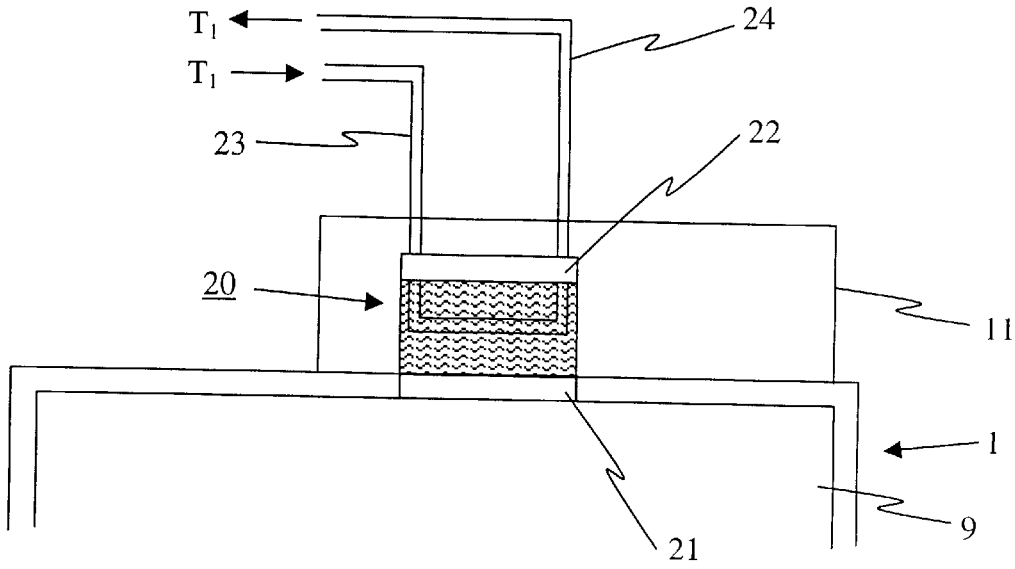
FIG. 4*a* is a simplified block diagram of a moveable unified heat exchanger according to a second embodiment of the instant invention, during a heating portion of a heat-treatment process.

Referring now to FIGS. 2*a* and 4*a,* simplified block diagrams of a moveable unified heat exchanger 20 in a first position are shown according to a second embodiment of the instant invention. The moveable unified heat exchanger 20 comprises a housing including a first insulated surface 21 and a second insulated surface 22, the housing for supporting at least a heat exchange surface whilst allowing atmospheric circulation therethrough. In the first position the moveable unified heat exchanger 20 is disposed adjacent to a wall surface 7 of a high temperature chamber, such as for instance a nitriding furnace 1. Most preferably, a surface of the moveable unified heat exchanger 20, such as for instance the first insulated surface 21, is substantially continuous with the surface 7 of the furnace 1. The first insulated surface 21 reduces heat transfer from the cavity 9 to the moveable unified heat exchanger 20 during the high-temperature portion of the nitriding process when the heat exchanger 20 is in the first position. An actuator (not shown) is provided for relatively moving the moveable unified heat exchanger 20 with respect to the furnace 1 to removeably insert the heat exchanger 20 at least partially into the cavity 9. The actuator is selected from a group including: a hydraulic actuator, a pneumatic actuator and a mechanical (chain/gear etc.) actuator. The heat exchanger 20 is in thermal communication with a heat sink (not shown).

In use, the workpieces 4 that are to be nitrided are arranged on a rack 3 and loaded into the cavity 9 for batch processing. The cavity 9 is hermetically sealed to allow a controlled atmosphere to be maintained around the workpieces 4 during the nitriding process. As such, the first insulated surface 21 of the moveable unified heat exchanger 20 must sealingly engage around its entire periphery the surface 7 in order to prevent leakage of the nitriding atmosphere from the cavity 9. An enclosure 11 for containing an atmosphere similar to the one contained within cavity 9 is provided around the heat exchanger 20 in order to prevent atmospheric mixing. Optionally, the gas pressure inside the cavity 9 is maintained above the external atmospheric pressure in order to prevent contaminants from entering the cavity 9. Heaters (not shown) supply heat to raise the temperature of the atmosphere within the cavity 9, and a fan 2 circulates continuously the atmosphere, as indicated by line 5, to ensure consistent heating of the workpieces 4. Preferably, the fan is an efficient atmosphere recirculation fan that permits a high degree of temperature uniformity to be reached in steady state conditions, with maximum deviations from ±2° C. (±3.6° F.) to ±5° C. (±9° F.), depending on the furnace size and arrangement. Optionally, a feedback control system (not shown) is provided for maintaining predetermined temperature and nitriding potential conditions, absent human intervention, during the nitriding process.

Figure 2B:
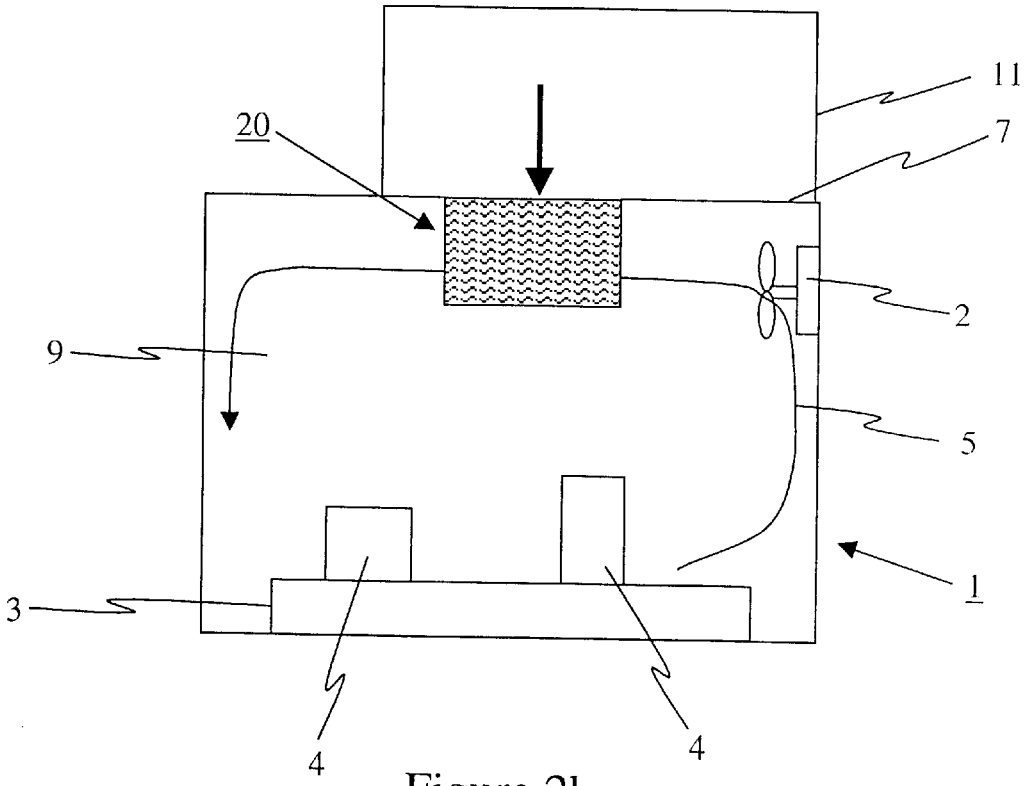
FIG. 2*b* shows a simplified block diagram of a moveable unified heat exchanger in a second position, according to a second embodiment of the instant invention.
Figure 4B:
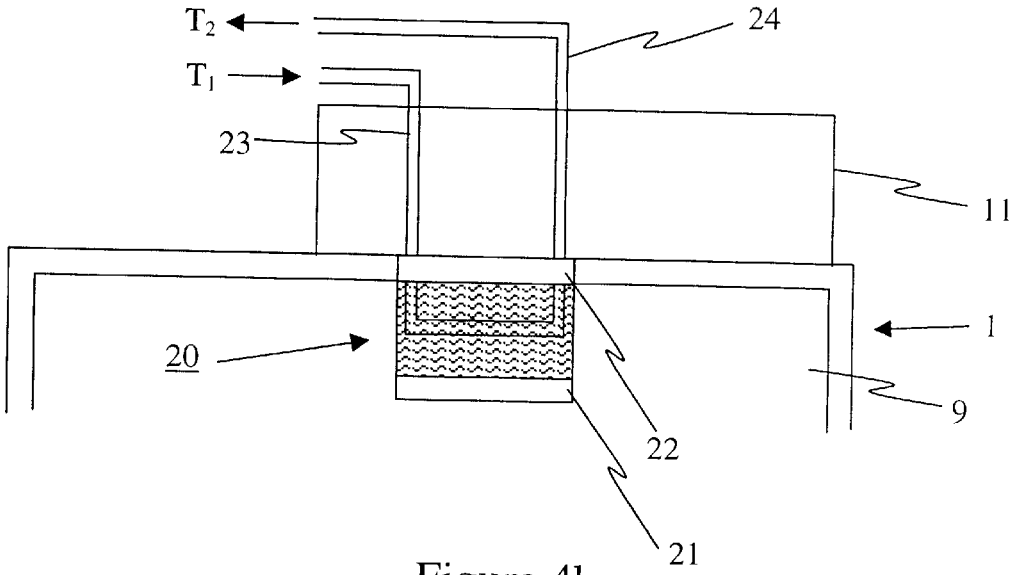
FIG. 4*b* is a simplified block diagram of a moveable unified heat exchanger according to a second embodiment of the instant invention, during a cooling portion of a heat-treatment process.

Referring now to FIG. 2*b* and 4*b,* shown are simplified block diagrams of a moveable unified heat exchanger according to a second embodiment of the instant invention in a second position. Those drawing elements identical to drawing elements described previously with reference to FIG. 2*a* and 4*a* have been assigned identical reference numerals, and their description is omitted here for the sake of brevity. When in the second position, the moveable unified heat exchanger 20 projects substantially through the opening in surface 7 so as to come into contact with the gas flow path 5. Of course, the second insulated surface 22 of the moveable unified heat exchanger 20 sealingly engages around its entire periphery the surface 7 in order to prevent leakage of the nitriding atmosphere from the cavity 9 when the heat exchanger 20 is in the second position. In use, heat is transferred from the gas flow 5 to the heat exchanger 20 when it is in the second position and conducted out of the cavity 9 to the heat sink. The fan 2 provides sufficient atmospheric circulation to ensure consistent cooling of workpieces 4 that are arranged on rack 3.

Referring again to FIGS. 4*a* and 4*b,* a heat transfer medium supply conduit 23 is shown in fluid communication with the unified heat exchanger 20. In use a fluid, such as for instance water, at a first temperature $T_1$ is provide to heat exchanger 20 via the supply conduit 23. The fluid is distributed throughout a network of smaller diameter conduits (not shown) for providing a high surface area for heat exchange within the heat exchanger 20. Heat within the cavity 9 is transferred to the fluid, which is subsequently discharged from the heat exchanger at a second higher temperature $T_2$ via a return conduit 24. Preferably, the water at the lower temperature $T_1$ is provided from a closed-loop water-cooling system, such as for instance a model WS-03-1 closed-loop system. By using clean water, free of contaminants typically present in municipal water lines, downtime for servicing due to corrosion and fouling is reduced.

Figure 5:
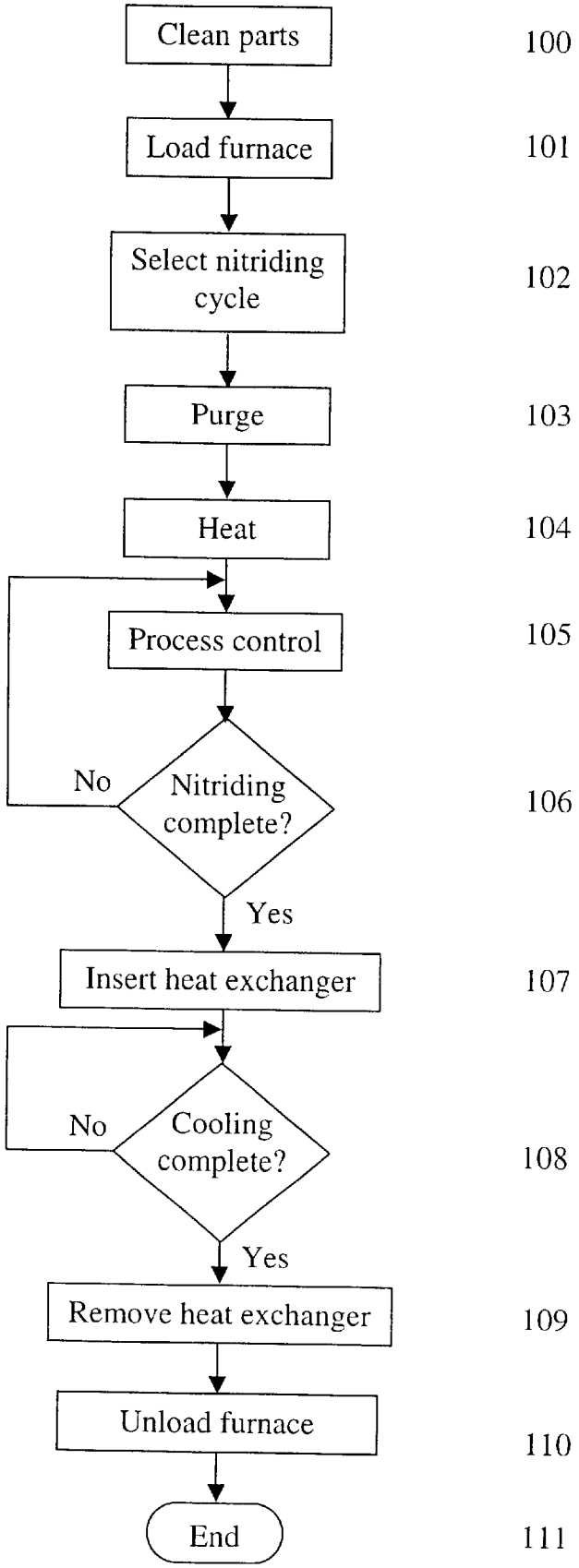
FIG. 5 is a simplified flow diagram of a method for nitriding parts according to the instant invention.

Referring now to FIG. 5, shown is a method for nitriding parts according to an embodiment of the instant invention. The parts are cleaned and loaded into a furnace at steps 100 and 101, respectively. At step 102 the user selects a nitriding cycle in dependence upon desired case properties, for instance by selecting a cycle from an existing library of nitriding cycles. Steps 103–109 are carried out under the control of an automated feedback control system absent user intervention. At step 103 the furnace is purged and an atmosphere having a predetermined composition is provided within the furnace. The parts are heated within the furnace at step 104 according to a temperature program selected in dependence upon the user selected nitriding cycle. Nitriding parameters, including furnace temperature and nitriding potential are monitored by the control system and adjusted to be within predetermined threshold values during step 105. When the end of the nitriding cycle is determined at step 106, the control system initiates a rapid cooling step at step 107 by removeably inserting a moveable heat exchanger into the furnace. When it is determined at decision step 108 that the final desired temperature has been attained, the heat exchanger is removed at step 109 in dependence upon a signal from the control system and the furnace is unloaded at step 110. The method of FIG. 5 terminates at step 111.

Alternatively, instead of inserting a sub-set of heat exchange elements into the gas atmosphere of the heating chamber, the heat exchange elements are partially inserted into the chamber to provide controllable cooling of the chamber wherein more of the heat exchanger is inserted into the chamber to provide more cooling therein.

Of course, while the instant invention has been described for use with one type of furnace only, it is to be understood that the inventors have envisaged a more general application to other types of furnaces, including pit furnaces, bell furnaces and horizontal furnaces. Further, the designs of the particular heat exchangers described supra for use with the preferred embodiments of the instant invention are intended as specific examples that are illustrative of the broader subject matter which the inventors consider to be inventive. Numerous other embodiments may be envisaged without departing from the spirit and scope of the invention.

What is claimed is:

1. A method for cooling a workpiece within a high-temperature chamber comprising the steps of:

a) heating the workpiece; and, b) moving a moveable heat exchanger into the high-temperature chamber, such that a cooling rate of the workpiece is achieved that is relatively faster than a cooling rate obtained absent the moveable heat exchanger.

2. A method for cooling a workpiece within a high-temperature chamber according to claim 1 including the step prior to step b) of:

a1) providing a heat exchanger moveable between a first position in which the heat exchanger is thermally isolated from a gas atmosphere contained by the high-temperature chamber and a second position in which the heat exchanger is in thermal communication with the gas atmosphere.

3. A method for cooling a workpiece within a high-temperature chamber according to claim 2 wherein the step b) of moving a moveable heat exchanger into the high-temperature chamber includes the steps of:

b1) maintaining a cooling medium of the heat exchanger at a first temperature when the heat exchanger is in the first position;

b2) moving the heat exchanger from the first position to the second position such that the heat exchanger at least partially contacts a flow of the gas atmosphere at a second temperature, the second temperature higher than the first temperature; and, b3) waiting for the temperature of the gas atmosphere to change from the second temperature to a predetermined threshold value lower than the second temperature.

4. A method for cooling a workpiece within a high-temperature chamber according to claim 3 wherein the step b3) of waiting for the temperature of the gas atmosphere to change includes the steps of:

b4) sensing a temperature of the gas atmosphere within the high-temperature chamber; and, b5) when the sensed temperature of the gas atmosphere is below the predetermined threshold value, moving the heat exchanger from the second position to the first position.

5. A method for cooling a workpiece within a high-temperature chamber according to claim 4 wherein the composition of the gas atmosphere is substantially unchanged when the moveable heat exchanger is moved.

6. A method for cooling a workpiece within a high-temperature chamber according to claim 1 wherein the composition of a gas atmosphere within the high-temperature chamber is substantially unchanged when the moveable heat exchanger is moved.

7. A method for cooling a workpiece within a high-temperature chamber according to claim 1 wherein the step a) of heating the workpiece includes the steps of:

loading the workpiece to be processed within the high-temperature chamber;

providing a predetermined gas atmosphere within the high-temperature chamber; and, heating the workpiece to the second temperature according to a predetermined temperature program.

8. A method for cooling a workpiece within a high-temperature chamber according to claim 7 wherein the step of providing a predetermined gas atmosphere includes the step of providing a substantially air-tight seal about the high-temperature chamber.

9. A method for cooling a workpiece within a high-temperature chamber according to claim 8 wherein the step of b) moving a moveable heat exchanger into the high-temperature chamber comprises the step of at least partially inserting the heat exchanger into the high-temperature chamber through a port in a wall surface thereof.

10. A method for cooling a workpiece within a high-temperature chamber according to claim 9 wherein the moveable heat exchanger makes a substantially air-tight seal with the port in the wall surface of the high-temperature chamber.

11. An apparatus for cooling a workpiece within a high-temperature chamber comprising:

a heat exchanger moveable between a first position in which the heat exchanger is thermally isolated from a gas atmosphere contained within the high-temperature chamber and a second position in which the heat exchanger is in thermal communication with the gas atmosphere;

an actuator operatively coupled to the heat exchanger for moving selectively the heat exchanger between the first position and second position through a port of the high-temperature chamber; and, a seal disposed between opposing surfaces of the heat exchanger and the port for substantially containing the gas atmosphere within the high temperature chamber.

12. An apparatus for cooling a workpiece within a high-temperature chamber according to claim 11 comprising a process controller in electrical communication with the actuator for providing a process control signal to the actuator, the process control signal for controlling the movement of the heat exchanger between the first position and second position.

13. An apparatus for cooling a workpiece within a high-temperature chamber according to claim 12 wherein the heat exchanger includes an insulation layer disposed adjacent to an external surface thereof and in thermal communication with the gas atmosphere such that, in use, heat substantially flows from the gas atmosphere to the heat exchanger, and when not in use, heat other than substantially flows from the gas atmosphere to the heat exchanger.

14. An apparatus for cooling a workpiece within a high-temperature chamber according to claim 13 wherein the heat exchanger comprises a elongate member for conducting heat therein.

15. An apparatus for cooling a workpiece within a high-temperature chamber according to claim 14 wherein the elongate member is a heat tube.

16. An apparatus for cooling a workpiece within a high-temperature chamber according to claim 13 wherein the heat exchanger comprises a plurality of individual elongate members for conducting heat therein, each elongate member sealingly engaging a separate port of the high-temperature chamber.

17. An apparatus for cooling a workpiece within a high-temperature chamber according to claim 16 wherein at least a subset of the plurality of elongate members is actuatable independently, such that an effective heat exchanger surface area is selectable from a range of predetermined values.

18. An apparatus for cooling a workpiece within a high-temperature chamber according to claim 16 wherein the plurality of elongate members is controllably movable between the first and second position for being partially in thermal communication with the gas atmosphere to provide for variable heat exchange with the gas atmosphere.

19. A heat treatment system comprising:

a moveable heat exchanger;

a high-temperature chamber having a port through a wall surface thereof for sealingly engaging an opposing surface of the heat exchanger and for permitting at least a portion of the heat exchanger to be removeably inserted within the high-temperature chamber, and having at least an orifice in communication with an atmosphere control system for providing a gas atmosphere with a predetermined composition;

an actuator operatively coupled to the heat exchanger for relatively moving the heat exchanger to the high-temperature chamber to selectively insert the at least a portion of the heat exchanger through the port;

a process controller in electrical communication with the actuator for providing to the actuator a first control signal for controlling the movement of the heat exchanger, wherein, in use, the heat exchanger is in thermal communication with the gas atmosphere when inserted in the high-temperature chamber and thermally isolated from the gas atmosphere when removed from the high-temperature chamber.

20. A heat treatment apparatus according to claim 19 wherein the high-temperature chamber includes an atmosphere circulation fan for providing an enhanced flow of the gas atmosphere to a heat exchanging surface of the heat exchanger when the at least a portion of the heat exchanger is inserted within the high-temperature chamber.

21. A heat treatment apparatus according to claim 19 wherein the high-temperature chamber includes a heater in electrical communication with the process controller for providing heat to the high-temperature chamber according to a predetermined temperature program.

22. A heat treatment apparatus according to claim 19 comprising at least a sensor in electrical communication with the process controller for sensing a parameter of a thermal process and for providing a second control signal to the process controller in dependence upon the sensed parameter, wherein the first control signal is provided from the process controller to the actuator in dependence upon the second control signal.

* * * * *